United States Patent [19]

Laukaitis

[11] 3,931,685

[45] Jan. 13, 1976

[54] LACELESS ELASTIC-TOPPED ATHLETIC SHOE

[76] Inventor: Hubert T. Laukaitis, P.O. Box 2406, Arlington, Va. 22202

[22] Filed: Nov. 15, 1974

[21] Appl. No.: 524,125

[52] U.S. Cl. ..... 36/2.5 A; 36/51

[51] Int. Cl.[2] ..... A43B 11/00

[58] Field of Search ..... 36/2.5 A, 2.5 AG, 9 R, 36/51, 45

[56] References Cited

UNITED STATES PATENTS

| | | | |
|---|---|---|---|
| 2,101,723 | 12/1937 | Smith | 36/2.5 AG |
| 3,067,532 | 12/1962 | Peterson | 36/9 R |
| 3,703,775 | 11/1972 | Gatti | 36/2.5 AG |

FOREIGN PATENTS OR APPLICATIONS

| | | | |
|---|---|---|---|
| 475,363 | 4/1929 | Germany | 36/51 |
| 1,225,359 | 3/1971 | United Kingdom | 36/2.5 AG |

*Primary Examiner*—Alfred R. Guest

[57] ABSTRACT

This invention relates to an elastic-topped athletic shoe for use by a football player wherein the lacing of a conventional shoe is replaced by an elastic panel integral with the shoe and forming the instep portion thereof, said panel being extended to connect integrally with a tubular elastic member encompassing the ankle of the wearer, said elastic panel and tube serving to retain the shoe securely on the wearer's foot.

4 Claims, 3 Drawing Figures

LACELESS ELASTIC-TOPPED ATHLETIC SHOE

Football players, and particularly punters, place-kickers and sometimes quarterbacks, are required to kick with speed and precision, and it is frequently found that a football kicked by a player is projected from that area of the instep where the lacing of a conventional shoe is located.

The minute unevenness of a shoe lacing on the player's foot may cause a deviation in the direction of travel of the ball from that intended by the kicker or required for the completion of a desired play in the game.

Some kickers avoid this difficulaty by using the front of the ankle as the area of contact between the kicker's foot and the ball. Other kickers may use the side of the instep to avoid contact of the lacings with the ball. However, there is the ever-present possibility of a lacing being brought into contact with the ball and causing it to deflect from the desired route of projection.

In this invention the lacings are omitted, and the shoe is formed with a conventional sole, and uppers rising at the forward end to a height equal to the top of the toes, said sole and abbreviated uppers being herein for convenience sometimes referred to as the "shoe member" of this invention.

Integrally attached to the upper edge of the shoe member, for a distance extending approximately from each ankel bone to the toes, is an elastic panel replacing the conventional top of a shoe. At the point where the elastic panel reaches the ankle bone, it is formed into a tubular ankle-encompassing member, the lower rear edge being free from attachment to the border of the shoe heel.

With the elastic-topped shoe of this invention, a kicker may use the front of his ankle, or the center or either side of his instep, as the point of contact with the football, and at any such point there is an assured smooth launching area for the ball.

Figure 1:
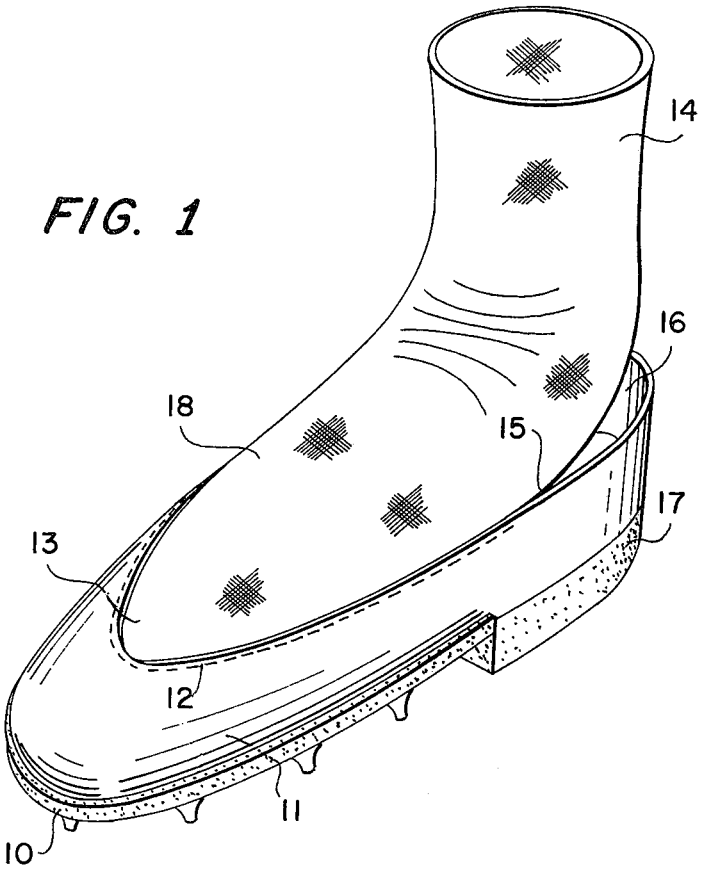
Figure 2:
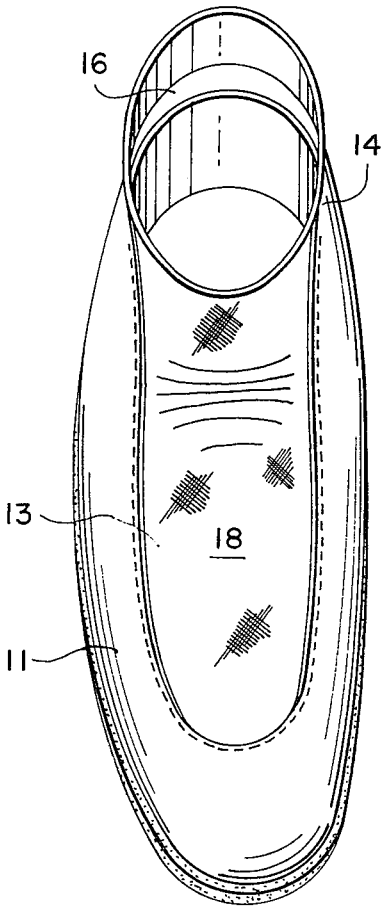

For a better understanding of this invention, reference is made to the accompanying drawings, wherein FIG. 1 is a side view of an elastic-topped shoe; and FIG. 2 is a front view of such shoe.

Figure 3:
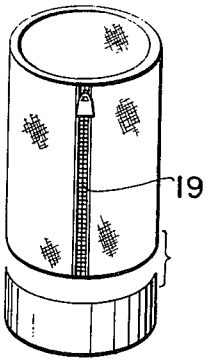

FIG. 3 is a rear view of a shoe showing fastener means for securing the edges of the ankle-encompassing member.

Referring more particularly to the drawings, FIG. 1 shows a conventional sole 10, with upper 11 forming a low surrounding wall around teh foot to permit integral attachment on line 12 of elastic panel 13 which forms the top portion covering the instep. Said panel 13 is formed integrally with anklet 14, said line of connection 12 being terminated as at 15 to provide space 16 between anklet 14 and heel 17 of said shoe.

The elastic panel 13 may be provided with added cushioning, having either increased elastic or leather or other suitable material, across the front of the ankle or the top of the foot, as in the shaded portion 18, and increased tension may be provided in the ankle-encompassing tube for added support of a kicker's ankle. The open space provided at the heel by the spacing between the shoe heel and the ankle-supporting tube permits flexing of the foot for complete freedom of movement.

The elastic anklet and instep panel provides assured retention of the shoe on the wearer's foot.

As an alternative to a tube formed to fit around the ankle, the ankle-encompassing member may be made of a sheet of elasticized material joined by a vertical fastener such as a zipper, which may be located either at the back or on one side of the ankle said fastener means being shown at 19 in FIG. 3 of the drawing.

Having thus disclosed my invention, I claim:

1. A laceless athletic shoe comprising a sole, a narrow strip attached to the entire edge of said sole and upstanding therefrom; an elasticized panel connected to the forward portion of said narrow strip, said elasticized panel encompassing the instep, and an elasticized ankle-encompassing member integral with and being a continuation of said elasticized panel; the rearward portion of the lower edge of said ankle-encompassing member being free rearwardly of the heel breast line, from connection to said narrow upstanding strip.

2. The invention of claim 1 wherein said instep elasticized portion is provided with a centrally disposed panel of thicker dimension than the remainder of said panel or of said ankle-encompassing tube, to cushion the foot of the wearer upon impact of the foot against a ball.

3. The invention of claim 1 wherein the said ankle-encompassing tube is provided with a front panel of thicker dimension than the remainder of said tube.

4. The invention of claim 1 wherein said ankle-encompassing tube is formed by vertical fastener means connecting two edges of an elasticized sheet encompassing the wearer's ankle.

* * * * *